United States Patent [19]

Fyfe et al.

[11] 4,187,573

[45] Feb. 12, 1980

[54] HIGH LOAD BEARING FOR BRIDGES AND SIMILAR STRUCTURES

[75] Inventors: Edward R. Fyfe, Burlington, Canada; Stewart C. Watson, Williamsville, N.Y.

[73] Assignee: Watson Bowman Associates, Inc., Buffalo, N.Y.

[21] Appl. No.: 919,390

[22] Filed: Jun. 26, 1978

Related U.S. Application Data

[63] Continuation of Ser. No. 812,477, Jul. 5, 1977.

[51] Int. Cl.[2] ..... E01D 19/06

[52] U.S. Cl. ..... 14/16.1; 248/580; 308/3 R; 52/167; 248/678

[58] Field of Search ..... 14/16.1; 52/167; 248/22; 308/3 R

[56] References Cited

U.S. PATENT DOCUMENTS

| | | | |
|---|---|---|---|
| 1,572,574 | 2/1926 | Stromborg | 52/167 X |
| 3,243,236 | 3/1966 | Graham | 14/16.1 X |
| 3,349,418 | 10/1967 | Hein | 14/16.1 |
| 3,397,856 | 8/1968 | Sullivan | 14/16.1 X |
| 3,544,176 | 12/1970 | Slater | 14/16.1 X |
| 3,782,788 | 1/1974 | Koester | 14/16.1 |
| 3,806,975 | 4/1974 | Fyfe | 14/16.1 |
| 3,908,054 | 9/1975 | Ito | 14/16.1 X |
| 3,921,240 | 11/1975 | Fyfe | 14/16.1 |
| 3,924,907 | 12/1975 | Czernik | 14/16.1 X |
| 4,033,005 | 7/1977 | Czernik | 14/16.1 |

*Primary Examiner*—Nile C. Byers, Jr.

*Attorney, Agent, or Firm*—Cushman, Darby & Cushman

[57] ABSTRACT

A high load bearing for bridges and other structures comprising upper and lower plates and a load bearing elastomer pad between them. The pad has a concave periphery, and the bearing is provided with means preventing shearing between the upper and lower plates but permitting rotational movement between them. Means are provided which mechanically abut the elastomer pad to limit or prevent lateral movement of the upper and lower surfaces of the elastomer pad without preventing bulging of its periphery.

5 Claims, 10 Drawing Figures

HIGH LOAD BEARING FOR BRIDGES AND SIMILAR STRUCTURES

This is a continuation, of application Ser. No. 812,474 filed July 5, 1977.

The present invention relates primarily to an improvement in bearings of the type described and claimed in U.S. Pat. Nos. 3,806,975 and 3,921,240. The bearings described in these patents are primarily intended for the support of the decks of bridges or piers and abutments wherein rotational and/or translational motion takes place between the bridge deck and the pier or abutment. However, the present invention also provides an improvement which is useful with bearings of somewhat similar general construction wherein there may be no rotation or translational movement between the bridge deck and the pier or abutment. The invention also is useful with bearings which support other structures such as buildings. The principal objective of the invention is to assure that the bearing will have the capability of sustaining very heavy loads and that the load carrying capability will be stabilized.

In bearings of the aforesaid type, an elastomeric pad, generally ¼ to 5 inches thick is fitted between two flat plates which in turn are secured between the bridge deck or some other structure and the pier, abutment or some other foundation. In the type of bearings described in the aforesaid patents, a third plate is mounted for sliding movement relative to one of the plates and anchored to the structure or the foundation to accommodate translational movement, and means are provided to minimize shearing strains in the elastomer without interfering with necessary rotation between the first and second plates and compression of the elastomer by the weight of the structure. The preferred type of elastomer pad is circular, and the lateral edge of the pad preferably is concave. In practice, the elastomer pads which have been used in this type of bearing have been biconical (i.e., they resemble a pair of conical sections, one inverted over the other).

Variations have been encountered in the load capabilities of the elastomer pad. This is evidenced by the load-deflection curve for the bearings wherein the deflection of a bearing under load is greater in some instances than in others. It now has been discovered that these variations can be attributed to variations in the bonding of the elastomer pad to the aforesaid plates above and below it, which is believed to have allowed the upper and lower surfaces of the biconical pad to spread laterally under load, to some extent irreversably. The present invention provides a structural means for preventing lateral spreading of the outer surfaces of the elastomer pad and therefore maximizing and stabilizing the load carrying capability of the bearings.

In a preferred form the invention also provides a safety element which protects the bearing pad from the hazard of overload and from separation from the aforesaid plates during rotation. Briefly, the structural means comprises means secured to the plate which provides a mechanical interlock with the elastomer pad so as to exert a force opposed to lateral growth of the upper and lower surfaces of the biconical or similar pad when it is compressed.

The invention will be better understood by reference to the following detailed description of preferred embodiments, reference being made to the drawing, in which.

Figure 1:
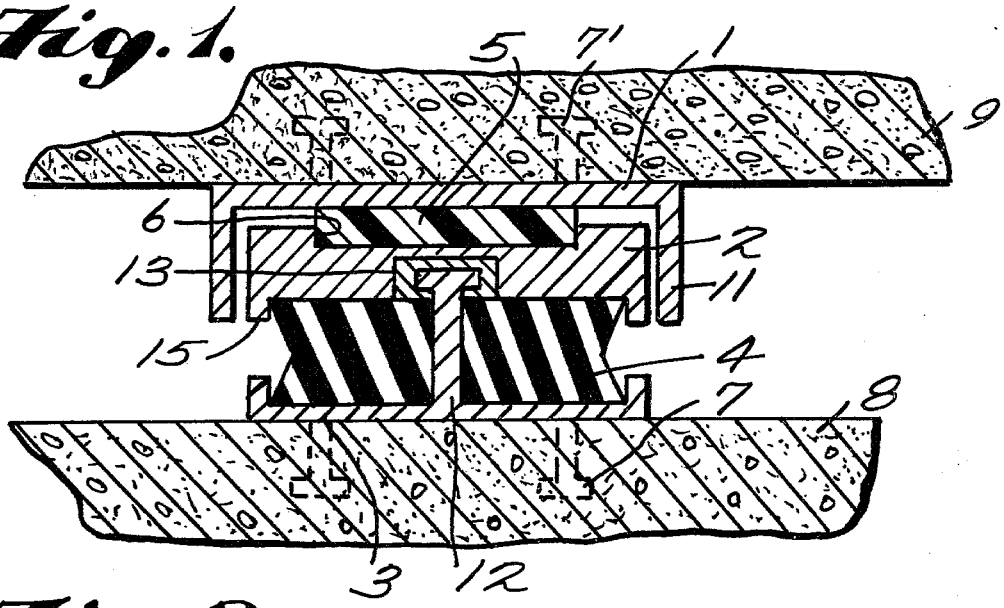
FIG. 1 is a cross section through a preferred form of the new bearing.
Figure 2:
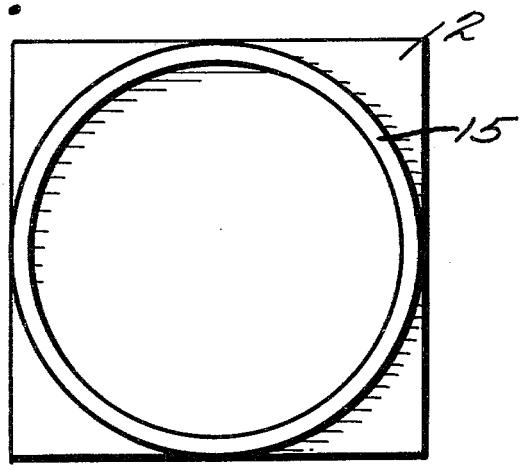
FIG. 2 is a plan view of a plate used in the bearing of FIG. 1.
Figure 4:
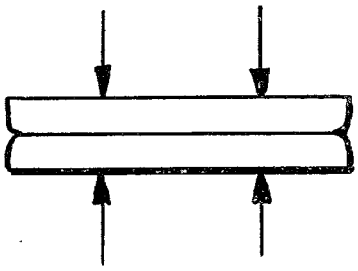
FIG. 4 is a side elevation of the bearing pad of the bearing of FIG. 1, when further compressed.

As shown in FIG. 1, the bearing comprises three steel components, a square top plate, a square middle plate 2 and a base plate 3. A circular bearing pad 4 is positioned between the middle plate 2 and the base plate 3 and a low friction plastic sheet 5 is positioned in a recess 6 in the top of middle plate 2 to reduce friction between middle plate 2 and top plate 1. The top plate 1 and the base plate 3 are fitted with concrete anchors 7 and 7' to secure them respectively to a bridge pier 8 and a bridge deck 9 although it will be understood that the bearings can be used in other kinds of construction. The top plate 1 is provided with depending side plates 10 and 11 which extend along opposite sides of the middle plate 2 to substantially confine relative sliding movement between the bridge deck 9 and the pier 8 to a single direction. However, it will be understood that other arrangements can be used, for example, to allow sliding movement in all directions, by omitting plates 10 and 11 or to substantially prevent sliding movement in all directions, depending upon the requirements of the structure.

The bearing is equipped with a pin 12, which is integral with the base plate 3 and which is engaged in a cylindrical collar 13 as described in U.S. Pat. Nos. 3,806,975 and 3,921,240 in connection with FIG. 3 thereof. The disclosure of said patents is incorporated herein by reference.

The bearing pad 4 is made from polyurethane elastomer, preferably 85 to 95 durometer, Shore A and is of biconical shape. The dimensions of the pad 4 depend on the weight the pad is expected to support, but typically the external diameter is 4 to 60 inches and the diameter at the midpoint 14 is typically ⅛ to 2 inches less than the diameter of the pad.

In accordance with the present invention, the top plate 2 is provided with a depending circular ring 15 which extends around the bearing pad, but whose internal diameter is slightly larger than the initial diameter of the bearing pad 4. Preferably, a clearance of 1/32 to ⅜ inch is provided. Similarly, the base plate 3 is provided with a raised ring 16 of the same diameter and it allows the same clearance.

Figure 3:
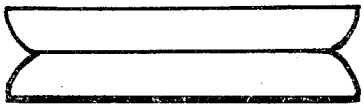
FIG. 3 is a side elevation of the bearing pad of the bearing of FIG. 1, when partly compressed.

The arrangement is such that, as initially assembled, the bearing pad does not contact either of the rings 15 and 16. However, as the bearing is compressed by the weight of the structure, two phenomena are observed. First, as illustrated in FIG. 3, the tapered sides of the pad bulge outwardly and towards each other. Ultimately, if the bearing is compressed sufficiently, the tapered sides of the pad 4 bulge outwardly to the extent that they contact the rings 15 and 16. However, the bearings are designed so that this does not occur at the design load. Thus the ring provides a safety factor which comes into effect if the bearing is overloaded. At the stage the shape factor of the pad is increased and it is substantially prevented from undergoing further compression.

The second phenomenon which is observed is that the diameter of the bearing pad 4 may increase slightly on its top and bottom surfaces, as described above, but growth is limited by the rings 15 and 16.

A third phenomenon is observed if the bearing is rotated or tilted. In this situation, the bearing pad is compressed more on one side than on the other side. When this occurs, the outwardly bulging tapered sides may contact the rings 15 and 16 in the area of greatest compression. When that occurs, further compression in that area is restricted in effect by changing the shape factor of the pad.

A further advantage of the invention follows from this arrangement. Because overcompression during tilting is avoided, it is possible to use relatively softer elastomer than otherwise would be possible. During rotational movements, soft elastomers can stretch a little, if needed, in the area opposite the compressed areas, and therefore, avoid separation from the plates 2 and 3, which otherwise might occur. As a result, the bearings can be rated for greater rotational movement than otherwise might be allowed.

The overall effect of the invention is to increase the rated loadings of the bearings. For example, it is presently believed that bearing pads which were rated at 2500 psi can now be rated at 3800 psi.

Further improvements in the bearings can be provided by other means which reduce the growth of the upper and lower surfaces of the pad 4. This is provided by a variety of mechanical interlock arrangements which provide an internally facing vertical or inclined surface of the middle plate 2 and/or the base plate 3 which abuts an outwardly facing vertical or inclined surface of the bearing pad 4 internally of the perimeter of the bearing pad. Several forms of abutting surfaces are illustrated in FIGS. 5–10.

Figure 5:
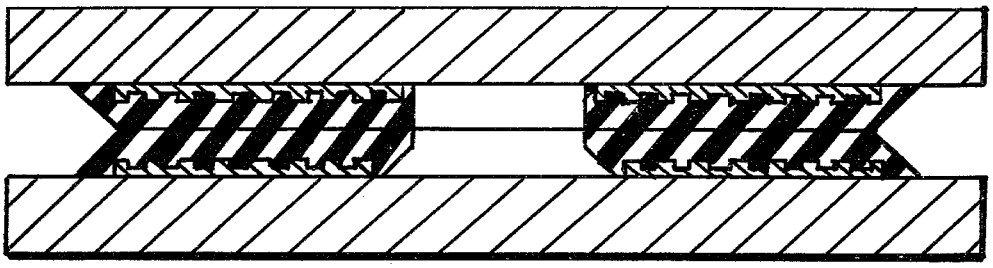
FIGS. 5–10 are cross sections through the bearing pad and adjoining plates of other embodiments of the bearing of the present invention.
Figure 6:
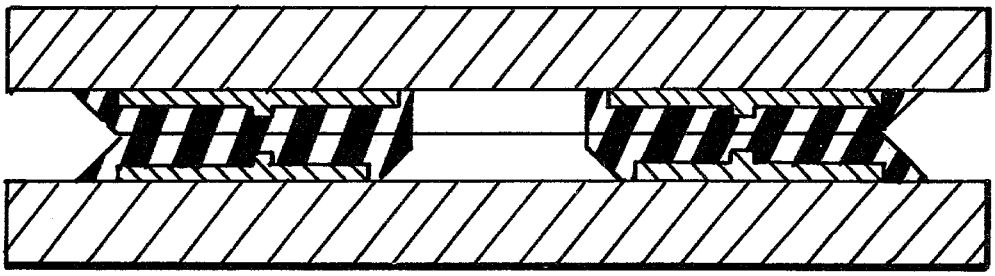
Figure 7:
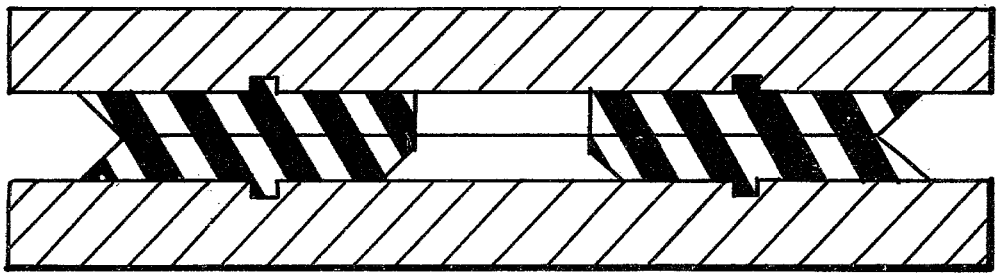
Figure 8:
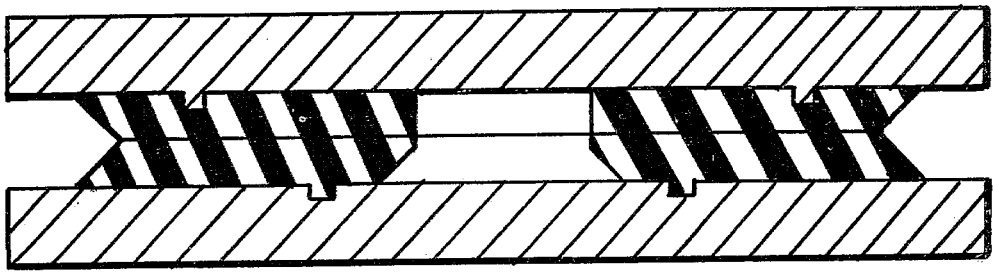
Figure 9:
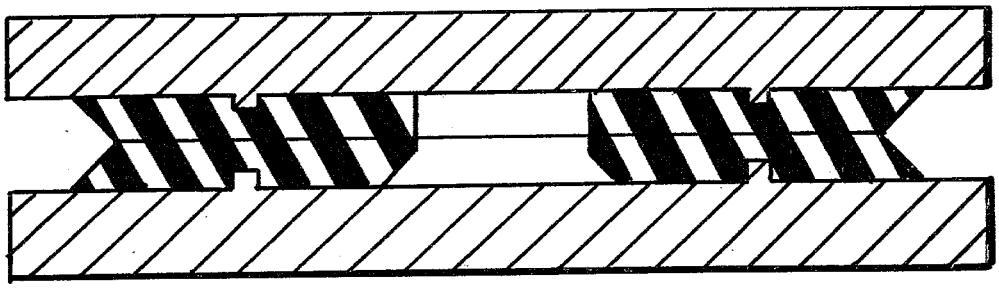
Figure 10:
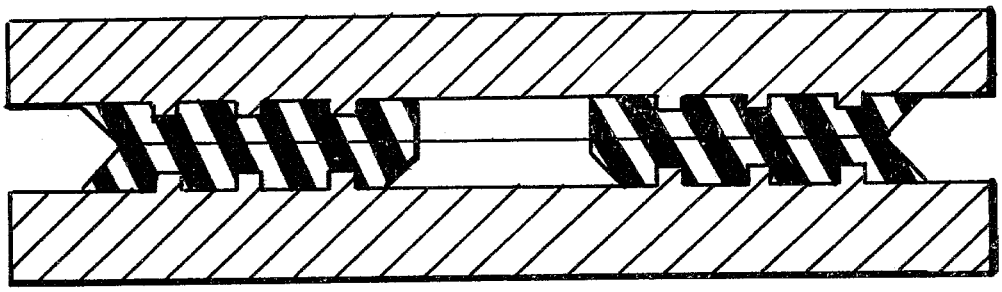

Thus in FIG. 5, metal rings 120 and 121 are fastened to the lower surface of plate 102 and the upper surface of plate 103. The metal rings 120 and 121 are formed with grooves 122 and 123 on their lower and upper surfaces respectively. The bearing pad 104 is forced into the grooves 122 and 123, thereby providing a mechanical interlock. In FIG. 6 there are rings 220 and 221 secured to the lower surface of plate 202 and the upper surface of plate 203 respectively. These metal rings 220 and 221 are formed with ribs 222 and 223 on their lower and upper surfaces respectively which press into the bearing pad 204. Therefore, a mechanical interlock is provided. In FIG. 7, there are circular grooves 320 and 321 formed in the lower and upper surfaces respectively of the plates 302 and 303. The bearing pad 304 is pressed into these grooves and therefore a mechanical interlock is achieved. In FIG. 8, there are circular ribs 420 extending downwardly from the lower surface of plate 402 and there is a circular groove 421 in the upper surface of lower plate 403. The ring 420 presses into the elastomer pad 404 and the pad is pressed into the groove 421. Therefore a mechanical interlock is accomplished. In FIG. 9, there are circular rings 520 and 521 extending downwardly and upwardly respectively from the plates 502 and 503. The rings 520 and 521 press into the bearing pad 504 to provide a mechanical interlock. FIG. 10 is quite similar to FIG. 9 except that in this case there are three rings 620, 620' and 620" extending down from the lower surface of the plate 602. Similarly, rings 621, 621' and 621" extend upwardly from the upper surface of plate 603. These rings press into the elastomeric bearing pad 604 to cause a mechanical interlock.

What is claimed is:

1. In a high load bearing comprising upper and lower plates which do not substantially increase their lateral dimensions under load, a load bearing elastomer pad on the upper surface of said lower plate and the lower surface of said upper plate being on the upper surface of said bearing pad, said elastomer pad having a groove extending around its periphery and a cooperating bearing member constructed and arranged to substantially prevent shearing movement between said plates and thereby substantially prevent shearing of said elastomer pad but permitting rotational movement between said plates, the improvement comprising means mechanically abutting said load bearing elastomer pad to at least limit lateral expansion of the upper and lower surfaces of said elastomer pad under load without preventing bulging of said periphery, said mechanically abutting means comprising means projecting from said plates adjacent the periphery of said load bearing elastomer pad, and in which a lateral clearance is provided between said surface of said load bearing elastomer pad and said projecting means when said bearing is not under load, whereby said load bearing elastomer pad is permitted limited lateral expansion before abutting said projecting means.

2. A high load bearing as set forth in claim 1 in which said lateral clearance is 1/32 to $\frac{3}{8}$ inch.

3. A high load bearing as set forth in claim 1 in which said load bearing elastomer pad and said projecting means are circular.

4. A high load bearing as set forth in claim 1 in which said load bearing elastomer pad is biconical.

5. A high load bearing as set forth in claim 1 wherein said peripheral groove extends from the upper surface to the lower surface of said load bearing elastomer pad.

* * * * *